US010337429B1

(12) United States Patent
Lauritano et al.

(10) Patent No.: US 10,337,429 B1
(45) Date of Patent: Jul. 2, 2019

(54) CONTROL APPARATUS AND METHOD FOR INTERNAL COMBUSTION ENGINE CYLINDER BALANCE

(71) Applicant: GM GLOBAL TECHNOLOGY OPERATIONS LLC, Detroit, MI (US)

(72) Inventors: Luca Lauritano, Turin (IT); Valerio Nuzzo, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/878,101

(22) Filed: Jan. 23, 2018

(51) Int. Cl.

| | |
|---|---|
| ***F02D 41/30*** | (2006.01) |
| ***F02D 41/00*** | (2006.01) |
| ***F02D 41/14*** | (2006.01) |
| ***F02D 41/38*** | (2006.01) |

(52) U.S. Cl.
CPC ..... *F02D 41/0085* (2013.01); *F02D 41/1473* (2013.01); *F02D 41/38* (2013.01); *F02D 41/3809* (2013.01); *F02D 2041/1409* (2013.01); *F02D 2200/0614* (2013.01); *F02D 2200/101* (2013.01)

(58) Field of Classification Search
CPC .... F02D 35/023; F02D 41/0085; F02D 41/38; F02D 41/1473; F02D 41/3809; F02D 41/26; F02D 41/3064; F02D 2041/1409; F02D 2200/101; F02D 2200/0614; F02D 2200/501; F02D 2250/21
USPC ..... 123/435, 436, 672, 480, 490; 701/103–105, 110, 111
See application file for complete search history.

(56) References Cited

U.S. PATENT DOCUMENTS 7,073,485 B2 * 7/2006 Truscott ..... F02D 35/023 123/406.22

* cited by examiner

*Primary Examiner* — Hai H Huynh
(74) *Attorney, Agent, or Firm* — Lorenz & Kopf LLP

(57) ABSTRACT

A method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine.

20 Claims, 2 Drawing Sheets

CONTROL APPARATUS AND METHOD FOR INTERNAL COMBUSTION ENGINE CYLINDER BALANCE

TECHNICAL FIELD

The technical field relates to methods and controllers for operating an internal combustion engine, and more particularly, the technical field relates to a method for operating an internal combustion engine to maintain cylinder balance.

BACKGROUND

An internal combustion engine for a motor vehicle generally includes an engine block defining at least one cylinder accommodating a reciprocating piston coupled to rotate a crankshaft. The cylinder is closed by a cylinder head that cooperates with the reciprocating piston to define a combustion chamber. A fuel and air mixture is cyclically disposed in the combustion chamber and ignited, thereby generating hot expanding exhaust gasses that cause the reciprocating movements of the piston. The fuel is injected into each cylinder by a respective fuel injector. The fuel is provided at high pressure to each fuel injector from a fuel rail in fluid communication with a high pressure fuel pump that increases the pressure of the fuel received from a fuel source. Operation of the internal combustion engine is generally controlled by one or more electronic control units (ECUs) operably coupled to an array of sensors and actuators associated with the internal combustion engine.

Balanced combustion within the plurality of cylinders of a typical internal combustion engine is important for reliable, low vibration, emission-compliant operation. A number of factors can introduce variability into the cylinder-to-cylinder and cycle-to-cycle combustion process. Factors affecting cylinder-to-cylinder combustion variability include: mechanical construction such as stroke length, head and piston heights, gasket and ring size, camshaft profile, fuel manifold, wave harmonics, etc.; engine and component condition such as worn rings, weak lifters, leaking fuel valves, spark plug and ignition coil degradation (for spark ignition engines), etc.; and combustion controls such as air/fuel ratio, ignition timing, engine cooling, etc.

The fuel injection system under the control of an ECU typically operates under closed-loop, integral feedback control, which can compensate for the foregoing factors that contribute to cylinder imbalance. However, during transient maneuvers such as cranking, high load/acceleration and the like, cylinder balance may be degraded during and following the transient maneuver as the closed-loop integral control does not anticipate the transient maneuver and takes time to converge. During this period of cylinder imbalance there exists the potential for adverse engine vibrations and emissions.

Accordingly, it is desirable to improve cylinder balance within an internal combustion engine especially during and following transient maneuvers.

SUMMARY

In accordance with the embodiment(s) described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance, wherein the second control strategy utilizes a dynamic factor based upon a second operating parameter of the internal combustion engine.

In accordance with another herein described exemplary embodiment, provided is a method of operating an internal combustion engine of a vehicle to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance, wherein the second control strategy utilizes a dynamic factor based upon a second operating parameter of the internal combustion engine. The first operating parameter and the second operating parameter are the same operating parameter.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance, wherein the second control strategy utilizes a dynamic factor based upon a second operating parameter of the internal combustion engine. The first operating parameter includes at least one of an engine speed and an engine speed moving average.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. The first operating parameter includes at least one of a fuel quantity request and a fuel request moving average.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. The second operating parameter includes at least one of an engine speed and an engine speed moving average.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance, wherein the second control strategy utilizes a dynamic factor based upon a second operating parameter of the internal combustion engine. The second operating parameter includes at least one of a fuel quantity request and a fuel request moving average.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance, wherein the second control strategy utilizes a dynamic factor based upon a second operating parameter of the internal combustion engine. The first control strategy is a closed loop integral control.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. The second control strategy is a closed loop integral control.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. The first control strategy and the second control strategy are closed loop integral controls.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. The first control strategy and the second control strategy are the same.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance, wherein the second control strategy utilizes a dynamic factor based upon a second operating parameter of the internal combustion engine. Cylinder balance is determined based upon cylinder-to-cylinder intermediate mean effective pressure standard deviation.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. Cylinder balance is determined based upon cylinder-to-cylinder exhaust gas emissions.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. Cylinder balance is provided by determining a fuel quantity data.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. Cylinder balance is provided by determining a fuel quantity data and controlling a fuel injector in accordance with the fuel quantity data.

In accordance with another embodiment described herein, a method of operating an internal combustion engine of a vehicle is provided to maintain cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine. The second operating mode is operable upon detection of and for a duration of a transient operation of the internal combustion engine.

In accordance with another embodiment described herein, a computer program product is provided with a program code which is stored on a non-transitory computer-readable medium that when executed in a controller is configured to provide cylinder balance. A first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine.

In accordance with another embodiment described herein, a vehicle includes an internal combustion engine with a plurality of cylinders and a quantity of fuel being delivered to each cylinder by a corresponding fuel injector, and each fuel injector being controlled via a controller operably coupled to each fuel injector. The controller is configured to provide cylinder balance having a first operating mode corresponding to a steady state operation of the internal combustion engine, which is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine.

In accordance with another embodiment described herein, a vehicle includes an internal combustion engine with a plurality of cylinders and a quantity of fuel being delivered to each cylinder by a corresponding fuel injector, and each fuel injector being controlled via a controller operably coupled to each fuel injector. The controller is configured with a control program retained within a memory system to provide cylinder balance having a first operating mode corresponding to a steady state operation of the internal combustion engine, which is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine.

In another embodiment described herein, a control system is provided for controlling an internal combustion engine having a plurality of cylinders, a quantity of fuel being delivered to each cylinder by a corresponding fuel injector, each fuel injector being controlled via a controller operably coupled to each fuel injector. The controller is configured to provide cylinder balance having a first operating mode corresponding to a steady state operation of the internal combustion engine, which is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine.

In another embodiment described herein, a control system is provided for controlling an internal combustion engine having a plurality of cylinders, a quantity of fuel being delivered to each cylinder by a corresponding fuel injector, each fuel injector being controlled via a controller operably coupled to each fuel injector. The controller includes a program code which is stored on a non-transitory computer-readable medium associated with the controller. The control program when executed in the controller is configured to provide cylinder balance having a first operating mode corresponding to a steady state operation of the internal combustion engine is differentiated from a second operating mode corresponding to a transient operation of the internal combustion engine based upon a first operating parameter of the internal combustion engine. In the first operating mode, a first control strategy provides cylinder balance. In the second operating mode, a second control strategy, different than the first control strategy, provides cylinder balance. The second control strategy utilizes a dynamic factor based upon a second operating parameter of the internal combustion engine.

BRIEF DESCRIPTION OF THE DRAWINGS

The present disclosure will hereinafter be described in conjunction with the following drawing figures, wherein like numerals denote like elements.

DETAILED DESCRIPTION OF THE DRAWINGS

The following detailed description is merely exemplary in nature and is not intended to limit the present disclosure or the application and uses of the present disclosure. Furthermore, there is no intention to be bound by any theory presented in the preceding background or the following detailed description. Exemplary embodiments will now be described with reference to the drawings, wherein conventional or commonly known elements may be omitted for clarity.

Figure 1:
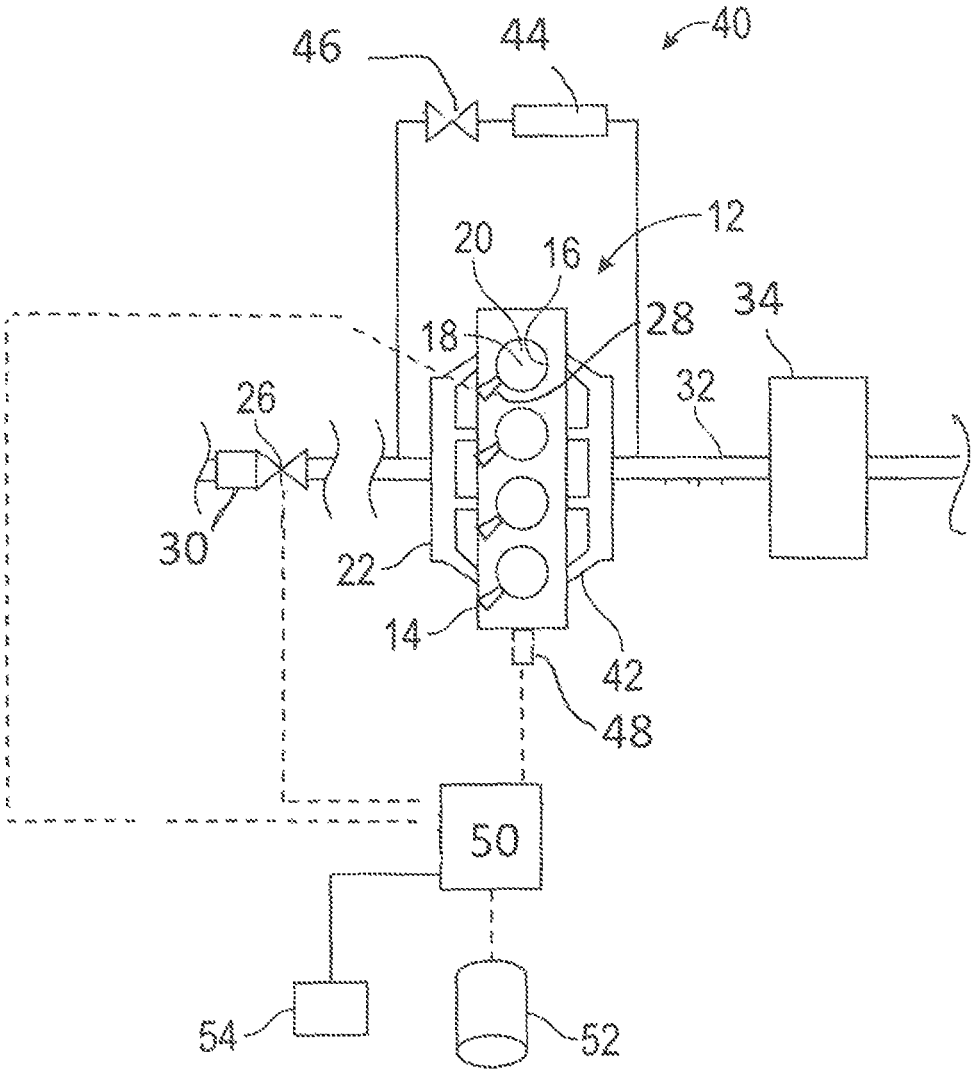
FIG. 1 is schematic representation of a vehicle incorporating an internal combustion engine that is operable in accordance with the herein described embodiments.

Some embodiments may be implemented within a motor vehicle that, as shown in FIG. 1, includes an internal combustion engine (ICE) 12 having an engine block 14 defining a plurality of cylinders 16 each having a piston 18 coupled to rotate a crankshaft. For each cylinder, a cylinder head cooperates with the piston 18 to define a combustion chamber 20. A fuel and air mixture is disposed in the combustion chamber 20 and ignited, resulting in hot expanding exhaust gasses causing reciprocal movement of the piston 18. The fuel is provided by at least one fuel injector 28 and the air through at least one intake port from an intake manifold 22. The fuel is provided at high pressure to the fuel injector 28 from a fuel rail in fluid communication with a high-pressure fuel pump that increases the pressure of the fuel received from a fuel source. Each of the cylinders 16 has at least two valves, actuated by a camshaft rotating in time with the crankshaft. The valves selectively allow air into the combustion chamber 20 and alternately allow exhaust gas to exit through an exhaust port.

The air may be distributed to the air intake port(s) through the intake manifold 22. An air intake duct 24 may provide air from the ambient environment to the intake manifold 22. In other embodiments, a throttle body 26 may be provided to regulate the flow of air into the manifold 22. In still other embodiments, a forced air system such as a turbocharger having a compressor rotationally coupled to a turbine may be provided. Rotation of the compressor increases the pressure and temperature of the air in the duct 24 and manifold 22, and an optional intercooler disposed in the duct 24 may be provided to reduce the temperature of the air.

The exhaust system 30 may include an exhaust pipe 32 having an after-treatment system 34 including one or more exhaust after-treatment devices. The after-treatment devices may be any device configured to change the composition of the exhaust gas. Some examples of after-treatment devices include, but are not limited to, catalytic converters (two and three way), such as diesel oxidation catalyst (DOC), lean NOx traps, hydrocarbon adsorbers and selective catalytic reduction (SCR) systems. The after-treatment system 34 may further include a diesel particular filter (DPF), which may be combined with the SCR to provide an SCRF system. Other embodiments may include an exhaust gas recirculation (EGR) system 40 coupled between the exhaust manifold 42 and the intake manifold 22. The EGR system 40 may include an EGR cooler 44 to reduce the temperature of the exhaust gases in the EGR system 40. An EGR valve 46 regulates a flow of exhaust gases in the EGR system 40.

The vehicle may further include an electronic control unit (ECU) 50 in communication with one or more sensors and/or devices operably associated with the ICE 12. The ECU 50 may receive input signals from various sensors configured to generate the signals in proportion to various physical parameters associated with the ICE 12. The sensors include, but are not limited to, a mass airflow and temperature sensor 56, which may be integrated with the throttle body 26, and a crank shaft position sensor 48. Additional sensors, without limitation, may include a manifold pressure and temperature sensor, a combustion pressure sensor, coolant and oil temperature and level sensors, a fuel rail pressure sensor, a cam position sensor, an exhaust pressure sensor and an exhaust temperature sensor, an EGR temperature sensor, and an accelerator pedal position sensor. Furthermore, the ECU 50 may generate output signals to various control devices that are arranged to control the operation of the ICE 12, including, but not limited to, the fuel injectors, the throttle body 26 and the EGR valve 46. Dashed lines depicted in FIG. 1 are used to indicate communication between the ECU 50 and the various sensors and devices, but some are omitted for clarity.

Turning now to the ECU 50, this apparatus may include a digital central processing unit (CPU) in communication with a memory system 52, and an interface bus. The CPU is configured to execute instructions stored as a program in the memory system 52, and to send and receive signals to/from the interface bus. The memory system 52 may include various storage types including optical storage, magnetic storage, solid-state storage, and other non-volatile memory. An operator interface 54, such as an interactive driver information center (DIC), touch screen interface, or any one or combination of display, switches and buttons (not depicted) to provide information to the operator and to accept input from the operator, is operably coupled to the ECU 50. The interface bus may be configured to send, receive, and modulate analog and/or digital signals to/from the various sensors, control devices and the operator interface 54. The program may embody the methods disclosed herein, allowing the CPU to carryout out the steps of such methods and to control the ICE 12.

The program stored in the memory system may be transmitted from outside via a cable or in a wireless interface. Outside the vehicle 10 it is normally visible as a computer program product, which is also called computer readable medium or machine readable medium, and which should be understood to be a computer program code residing on a carrier, whether transitory or non-transitory in nature, with the consequence that the computer program product can be regarded to be transitory or non-transitory in nature.

An example of a transitory computer program product is a signal, e.g. an electromagnetic signal, which is a transitory carrier for the computer program code. Carrying such computer program code can be achieved by modulating the signal by a conventional modulation technique for digital data, such that binary data representing the computer program code is impressed on the transitory electromagnetic signal. Such signals may be made use of when transmitting computer program code in a wireless fashion via a WiFi connection from/to a laptop computer or other computing device.

In the case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an application specific integrated circuit (ASIC), a CD or DVD or the like.

Instead of an ECU 50, the vehicle 10 may have a different type of processor to provide the electronic logic, e.g. an embedded controller, an onboard computer, or any processing module that might be deployed in the vehicle.

Figure 2:
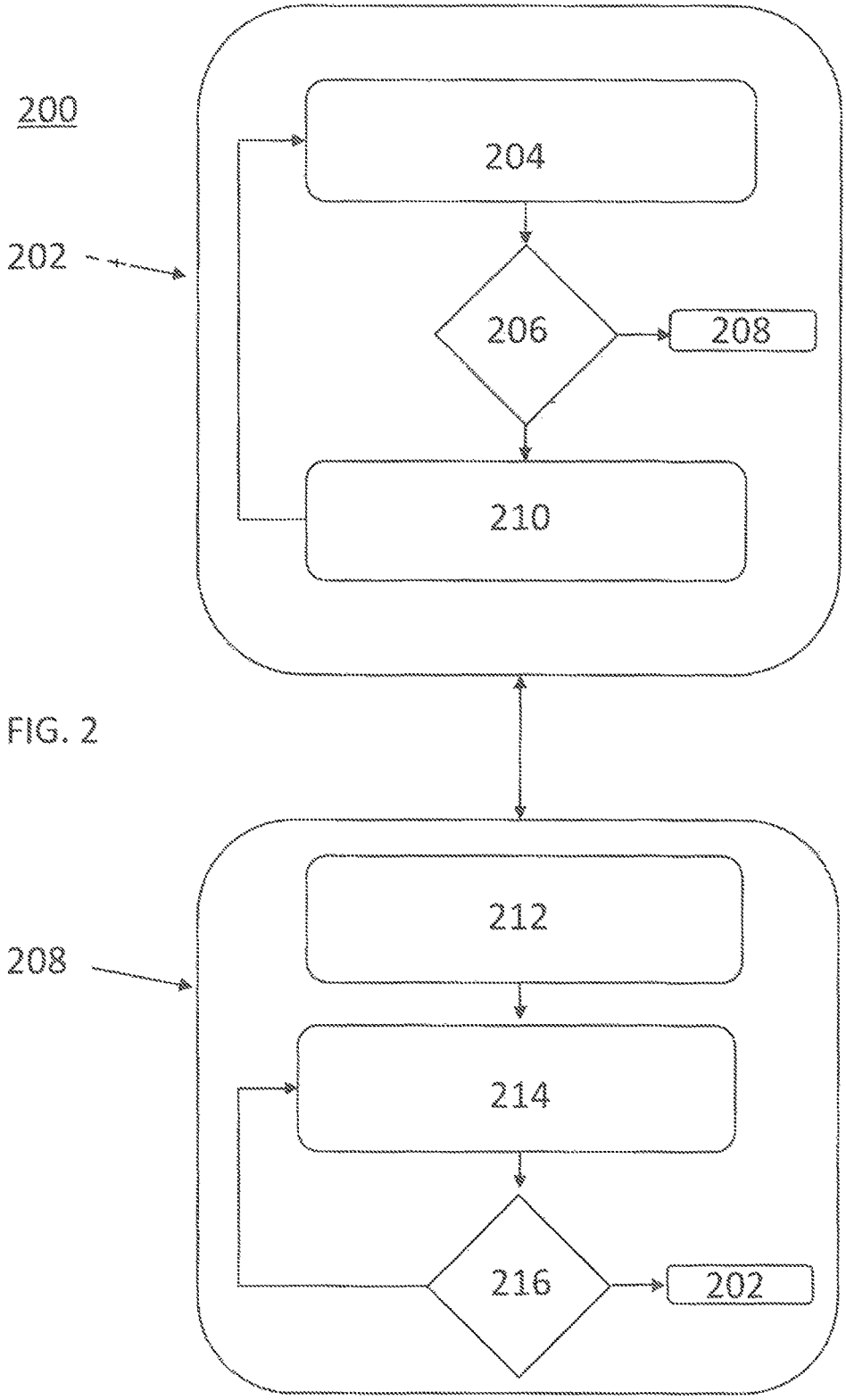
FIG. 2 is a flowchart depicting operation of an internal combustion engine in accordance with the herein described embodiments.

FIG. 2 depicts a control process 200, which may be provided as a non-transitory computer program product provided to and retained within the memory system, or may be a computer program stored within the memory system or may be embodied combinations of control programs, electronic logic and/or computer and processing devices deployed within the vehicle. The control process 200 is configured to provide in a first operating mode 202 steady-state engine operation cylinder balance, and to provide in a second operating mode 208 transient engine operation cylinder balance upon detection of and for the duration of a transient operation of the ICE 12.

In non-limiting exemplary embodiments, steady state operation may be distinguished from transient operation based on one or more engine operation parameters. For example, engine speed may be determined in a conventional manner using data from any number of sensors associated with the ICE 12 and operably coupled to the ECU 50 such that a change in engine speed relative to a predetermined threshold is indicative of a change from steady state to transient operation. In another non-limiting example, a change in the engine speed moving average may be compared to a predetermined threshold. Similarly, requested fuel quantity data may be monitored in either absolute terms or as a change from a moving average. As will be appreciate a determination that a change from steady state operation has occurred may be based upon virtually any number and type of engine operating parameters or conditions, he above stated examples being merely representative.

In the control process 200 depicted in FIG. 2, engine operating parameter data is obtained at block 204, and the engine operating parameter data is evaluated at block 206. If the engine operating data is indicative of transient engine operation, the transient operating mode 208 is initiated. Otherwise, a cylinder balance control 210 is implemented providing steady state cylinder balance.

Under steady state, cylinder balance is provided via closed loop control implemented as an integral control strategy. The strategy may take crank shaft position data obtained from the crank shaft position sensor 48 to determine cylinder indicated mean effective pressure (IMEP) with the goal to achieve an IMEP cylinder-to-cylinder standard deviation below a threshold value. Cylinder balance is achieved by generating fuel quantity correction data utilized in the control of the fuel injectors 28 to provide modified injected fuel quantities on a per-cylinder basis to reduce the IMEP standard deviation to be at or below the target value. Consideration may also be given to one or more exhaust gas emissions measures to achieve a cylinder-to-cylinder exhaust gas emission standard deviation below a target value. Other steady state cylinder balance strategies and measures may be utilized without limiting the generality of the present disclosure.

Upon detection of transient operation, at block 206, the control process 200 enters the second operating mode 208. The second operating mode 208 is operable to provide cylinder balance upon detection of and for the duration of transient operation utilizing a control strategy. Generally, the control strategy associated with the second operating mode 208 will utilize a dynamic factor, which is determined at block 212. In exemplary embodiments, the dynamic factor is determined based upon one or more engine operating parameters. For example, the dynamic factor may by determined based upon the change in engine speed, change in engine speed moving average, requested fuel quantity, change in requested fuel quantity and combinations of one of these parameters or combinations of one or more of these parameters with one or more additional parameters. Advantageously, the dynamic factor may be based upon the operating parameter or operating parameters evaluated to differentiate stead state operation from transient operation.

In an exemplary embodiment, the second operating mode 208 may utilize the integral control strategy utilized in the first operating mode 202 during steady state operation. Different from the steady state integral control strategy, in the second operating mode 208 the dynamic factor determined at 212 is utilized to modify one or more control parameters of the integral control strategy, e.g., adjusting the gain of the integral control, to provide a modified control response. At block 214, a cylinder balance control utilizing the dynamic factor is implemented providing transient operation cylinder balance. The second operating mode 208 remains active upon detection of and for the duration of transient operation, at block 216, but once steady state operation is reestablished, cylinder balance is accomplished in accordance with the first operating mode 202.

In accordance with the herein described embodiments, cylinder balance is achieved within an internal combustion engine (ICE) utilizing a cylinder balance control strategy. One or more ICE operating parameters, such as requested fuel and/or engine speed moving average is used to differentiate steady state operation from transient operation. In transient operation, a dynamic factor depending upon one or more ICE operating parameters, and advantageously which also may be the requested fuel and/or engine speed moving average, may be used to determine the dynamic factor. A control strategy utilizing the dynamic factor is then used to achieve cylinder balance.

While at least one exemplary embodiment has been presented in the foregoing detailed description, it should be appreciated that a vast number of variations exist. It should also be appreciated that the exemplary embodiment is only an example, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. A method of operating an internal combustion engine of a vehicle to maintain cylinder balance, the internal combustion engine including a plurality of cylinders, a quantity of fuel being delivered to each cylinder by a corresponding fuel injector, each fuel injector being controlled via a controller operably coupled to each fuel injector, wherein the controller includes a program code which is stored on a non-transitory computer-readable medium associated with the controller, that when executed in the controller is configured to carry out the method comprising:

differentiating by the controller a first operating mode corresponding to a steady state operation of the internal combustion engine from a second operating mode corresponding to a transient operation of the internal combustion engine based upon a first operating parameter of the internal combustion engine, wherein the transient operation comprises at least one of a change of engine speed, a change of engine speed moving average, a change of fuel quantity request, a change of fuel quantity moving average;

in the first operating mode, implementing a first control strategy providing cylinder balance; and in the second operating mode, implementing a second control strategy, different than the first control strategy, providing cylinder balance, wherein the second control strategy utilizes a dynamic factor based upon a second operating parameter of the internal combustion engine.

2. The method of claim 1, wherein the first operating parameter and the second operating parameter are the same operating parameter.

3. The method of claim 1, wherein the first operating parameter comprises at least one of an engine speed and an engine speed moving average.

4. The method of claim 1, wherein the first operating parameter comprises at least one of a fuel quantity request and a fuel request moving average.

5. The method of claim 1, wherein the second operating parameter comprises at least one of an engine speed and an engine speed moving average.

6. The method of claim 1, wherein the second operating parameter comprises at least one of a fuel quantity request and a fuel request moving average.

7. The method of claim 1, wherein the first control strategy comprises a closed loop integral control.

8. The method of claim 1, wherein the second control strategy comprises a closed loop integral control.

9. The method of claim 1, wherein the first control strategy and the second control strategy are closed loop integral controls.

10. The method of claim 1, wherein the first control strategy and the second control strategy are the same.

11. The method of claim 1, further comprising determining a cylinder-to-cylinder intermediate mean effective pressure standard deviation to affect cylinder balancing.

12. The method of claim 1, further comprising determining cylinder-to-cylinder exhaust gas emissions to affect cylinder balancing.

13. The method of claim 1, further comprising determining a fuel quantity data to affect cylinder balancing.

14. The method of claim 13, further comprising controlling the fuel injector in accordance with the fuel quantity data.

15. The method of claim 1, wherein the second operating mode is operable upon detection of and for a duration of the transient operation of the internal combustion engine.

16. A computer program product with a program code which is stored on a non-transitory computer-readable medium, that when executed in the controller is configured to carry out the method according to claim 1.

17. A vehicle comprising the controller configured to carry out the method according to claim 1.

18. A vehicle comprising the controller, wherein the controller includes a program code which is stored on a non-transitory computer-readable medium associated with the controller, that when executed in the controller is configured to carry out the method according to claim 1.

19. A control system including the controller for controlling the internal combustion engine, wherein the control system is configured to carry out the method according to claim 1.

20. A control system including the controller for controlling the internal combustion engine, wherein the control system includes a program code which is stored on a non-transitory computer-readable medium associated with the control system, that when executed in the controller is configured to carry out the method according to claim 1.

* * * * *